US008460754B2

(12) United States Patent
Nelson et al.

(10) Patent No.: US 8,460,754 B2
(45) Date of Patent: Jun. 11, 2013

(54) NEEDLE COATING AND IN-LINE CURING OF A COATED WORKPIECE

(75) Inventors: James M. Nelson, Lino Lakes, MN (US); Mitchell A. F. Johnson, Maplewood, MN (US); William B. Kolb, West Lakeland, MN (US); Patrick R. Fleming, Lake Elmo, MN (US); Paul E. Humpal, Stillwater, MN (US); Chieu S. Nguyen, Woodbury, MN (US); Charles A. Evertz, New Brighton, MN (US); Jack W. Lai, Lake Elmo, MN (US); Mikhail L. Pekurovsky, Bloomington, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 304 days.

(21) Appl. No.: 12/642,937

(22) Filed: Dec. 21, 2009

(65) Prior Publication Data

US 2011/0151199 A1 Jun. 23, 2011

(51) Int. Cl.
*B05D 5/00* (2006.01)

(52) U.S. Cl.
USPC ..... 427/256; 427/240; 427/261; 427/277; 427/286; 427/425

(58) Field of Classification Search
USPC ..... 427/256, 261, 240, 286, 355, 358, 427/420, 512
See application file for complete search history.

(56) References Cited

U.S. PATENT DOCUMENTS

| | | | | |
|---|---|---|---|---|
| 4,291,642 | A | 9/1981 | Kole | |
| 4,584,964 | A | 4/1986 | Engel | |
| 4,592,939 | A | 6/1986 | Temple et al. | |
| 4,922,852 | A | 5/1990 | Price | |
| 4,941,428 | A | 7/1990 | Engel | |
| 6,139,639 | A | 10/2000 | Kitamura et al. | |
| 6,350,490 | B1 * | 2/2002 | Bressler et al. | 427/277 |
| 6,408,753 | B1 | 6/2002 | Finn et al. | |
| 6,521,330 | B2 | 2/2003 | Finn et al. | |
| 6,887,588 | B2 | 5/2005 | Simpson et al. | |
| 2003/0054107 | A1 | 3/2003 | Trabold et al. | |
| 2005/0143483 | A1 * | 6/2005 | Sanuki et al. | 522/99 |
| 2005/0255249 | A1 | 11/2005 | Schlatterbeck et al. | |
| 2007/0020451 | A1 | 1/2007 | Padiyath et al. | |
| 2007/0235902 | A1 | 10/2007 | Fleming et al. | |
| 2009/0004401 | A1 * | 1/2009 | Nojo et al. | 427/508 |
| 2009/0127238 | A1 | 5/2009 | Corrigan et al. | |
| 2010/0189916 | A1 * | 7/2010 | Watanabe | 427/512 |

FOREIGN PATENT DOCUMENTS

| | | |
|---|---|---|
| EP | 1 158 365 | 11/2001 |
| EP | 1 947 484 | 7/2008 |
| WO | WO 02/071153 | 9/2002 |

OTHER PUBLICATIONS

Seggern et al., "Coating Reactively Rotational Coating of Rolls and Pipes With Highly Reactive PU Systems", vol. 89, No. 9, 1999, pp. 52-55.

* cited by examiner

*Primary Examiner* — Nathan Empie
*Assistant Examiner* — Xiao Zhao

(57) ABSTRACT

A method for coating a work piece with resin including applying a controlled volume of liquid resin to the work piece with an applicator and allowing consecutive streams of resin to meld together to form a self leveling surface. The resin can be actively or passively cured. The work piece can be planar or cylindrical.

20 Claims, 5 Drawing Sheets

NEEDLE COATING AND IN-LINE CURING OF A COATED WORKPIECE

FIELD OF INVENTION

The present disclosure relates to needle coating methods for work pieces, more specifically, work pieces such as those used in creating microreplicated structures.

BACKGROUND

Roll tools and other types of work pieces are used in a variety of applications including, for example, replication and microreplication. Work pieces can be made from a variety of materials, including metals and polymers. After a work piece is formed, a desired pattern for replication, often with micron-scale features is imprinted on the surface of the work piece. Patterning can be achieved through several different methods including diamond turning, lithography, and laser ablation. For laser ablation to be successful, the surface must be an appropriate substrate for ablation. While metals and ceramics can be ablated, polymers often ablate at a more rapid pace. Polymeric substrates appropriate for ablation can be coated over metal work pieces. A need exists for additional ways to coat polymeric substrates on a work piece to create a smooth finish with even thickness.

SUMMARY

A first method, in accordance with the present disclosure, is for coating a work piece with resin. The method includes providing a generally cylindrically shaped work piece and rotating the work piece about a longitudinal axis. The method further includes providing an applicator and applying a controlled volume of liquid resin to the work piece with the applicator as a lateral location of the applicator along the surface of the work piece is shifted such that the resin is deposited on the work piece along a helical path. The resin is deposited such that consecutive rings of resin are allowed to meld together to form a self-leveling surface. The method further includes actively or passively curing at least a portion of the resin during the applying step.

A second method, consistent with the present disclosure, is for coating a work piece with resin. The method includes providing a generally planar work piece and providing an applicator. The method next includes applying a controlled volume of liquid resin to the work piece with the applicator as a lateral location of the applicator along the surface of the work piece is shifted such as resin is deposited on the work piece. The resin is deposited such that consecutive streams of resin are allowed to meld together to form a self-leveling surface. The method further includes actively or passively curing at least a portion of the resin during the applying step.

A cylindrical work piece for use in microreplication, consistent with the present disclosure, is prepared by a process as detailed below. The process first includes rotating the work piece about a longitudinal axis and providing an applicator. The process then includes applying a controlled volume of liquid resin to the work piece with the applicator as a lateral location of the applicator along the surface of the work piece is shifted such that the resin is deposited on the work piece along a helical path. The resin is deposited such that consecutive rings of resin are allowed to meld together to form a self-leveling surface. Finally, the method includes actively or passively curing at least a portion of the resin during the applying step.

DETAILED DESCRIPTION

The system and method for coating a work piece detailed in the present disclosure can, in some embodiments, create a smooth, substantially seamless surface with uniform resin thickness. In some embodiments, a metal substrate of the work piece can enhance the ablation process by acting as an etch stop. Such a work piece can be ablated rapidly and precisely. Some patterns that may be ablated onto the work piece include lenses, text, cylindrical holes, posts and any other desired feature. An exemplary system for ablating such a work piece is disclosed in United States Published Patent Application No. 2009/0127238, entitled "Seamless Laser Ablated Roll Tooling," incorporated herein by reference as if fully set forth. Achieving precise laser ablation can enhance the performance of a work piece in processes such as microreplication for a variety of applications.

Figure 1:
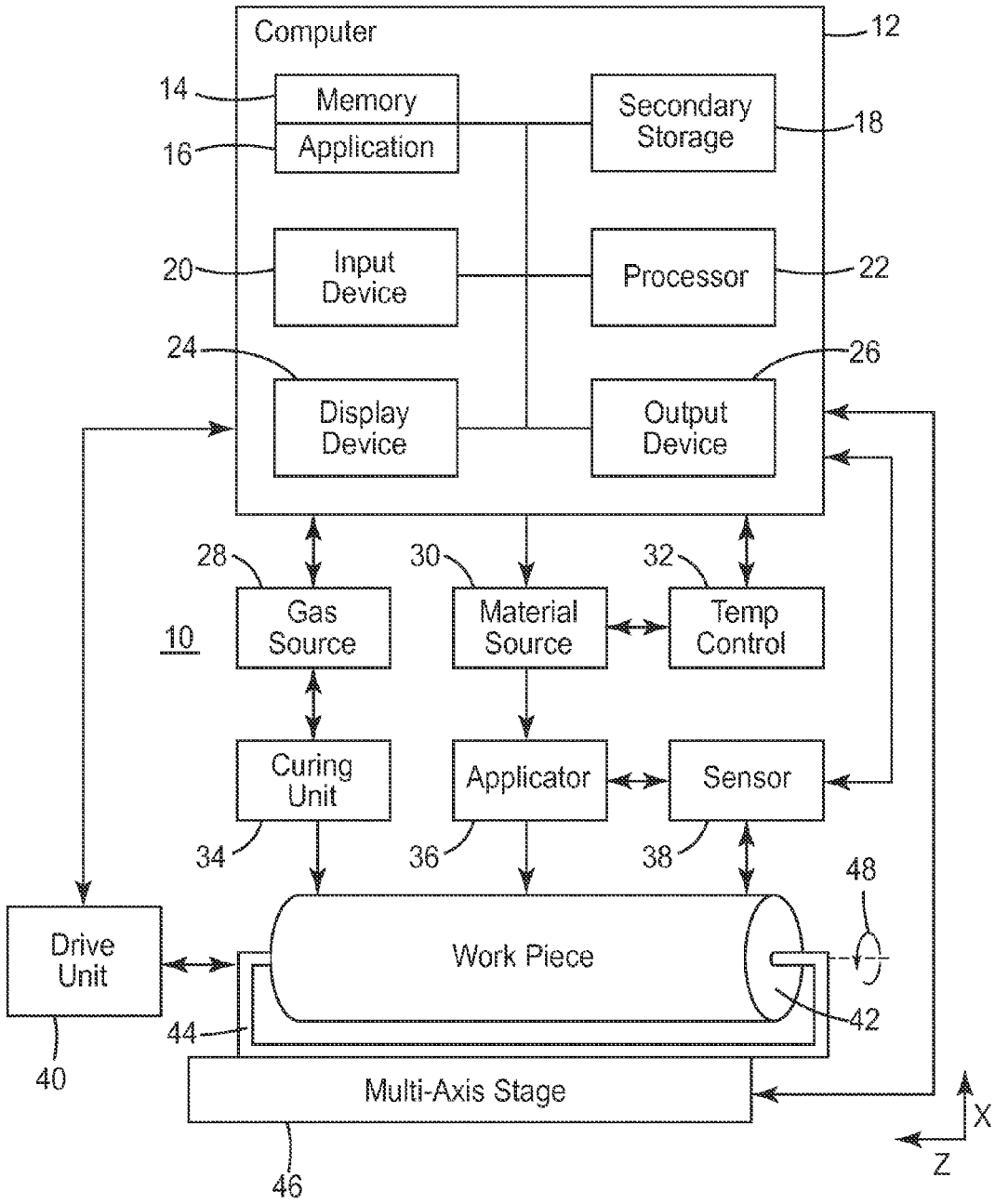
FIG. 1 is a block diagram of a system for coating a cylindrical work piece with resin.

FIG. 1 shows a block diagram of an exemplary system 10 for coating a cylindrical work piece 42 with resin. System 10 is controlled by a computer 12. Computer 12 has, for example, the following components: a memory 14 storing one or more applications 16; a secondary storage 18 providing for non-volatile storage of information; an input device 20 for receiving information or commands; a processor 22 for executing applications stored in memory 16 or secondary storage 18, or received from another source; a display device 24 for outputting a visual display of information; and an output device 26 for outputting information in other forms such as speakers for audio information or a printer for a hardcopy of information.

Work piece 42 can be implemented with a metal roll or a roll made of another appropriate material. For example, work piece can include aluminum, nickel, brass, copper, steel, chrome, glass, ceramic rubber, silicones, polyolefins, pure acrylics and fluoropolymers. Work piece 42 can be formed from a substrate made of one or more materials, for example, aluminum, which is then coated with a second material, for example, nickel. In one embodiment, work piece can have a hollow center. In another embodiment, work piece 42 can be a hollow cylinder with one closed and one open end. The closed end can be used to mount work piece 42 to mount 44. In such an embodiment, mount 44 may have only one upwardly extending arm.

Applicator 36 performs the coating of work piece 42. Applicator 36 may be a flat-tipped needle or non-flat tipped needle with any appropriately shaped cross section, for example, rectangular, square, or round. In one embodiment, applicator 36 can be positioned relative to the work piece 42 by clamping it to a magnetic base and positioning it horizontally and normally to a tangent point of the work piece 42. In another embodiment, applicator 36 may be vertical or at any other angle relative to work piece 42.

Material source 30 serves as a source of resin or any other material being applied to the surface of work piece 42. Material source 30 may be, for example, a syringe with a pump that compresses the plunger of the syringe at a specific velocity to produce a controlled volumetric flow of material through applicator 36 and on to work piece 42. The compression speed and resulting flow rate from material source 30 can be controlled by computer 12.

Material contained in material source 30 and applied to work piece 42 can be a variety of resins. Examples of polymeric materials for machining are described in U.S. patent application Ser. Nos. 11/278,278 and 11/278,290, both of which were filed Mar. 31, 2006 and are incorporated herein by reference as if fully set forth. A diamond-like-glass (DLG) coating can be used to make a durable tool from a laser ablated polymer roll. DLG is described in U.S. patent application Ser. No. 11/185,078, filed Jul. 20, 2005, which is incorporated herein by reference as if fully set forth. After a roll is patterned by any desired method, for example, laser ablation, a fluoropolymer coating can also be used to improve the durability of an ablated roll.

The temperature of the material or resin applied to work piece 42 can be controlled by computer 12 through temp control 32. Temp control 32 can include, for example, a heater coupled to material source 30. A feedback device between material source 30 and temp control 32 can allow computer 12 to control the temperature of material in material source 30 so as to maintain it at a constant level. In some embodiments, maintaining a constant temperature can result in consistent flow of material, effective melding of consecutive streams of material or resin on work piece 42, and appropriate curing of resin after application to work piece 42.

To apply resin to the surface of work piece 42, applicator 36 can be held stationary as work piece 42 is translated and rotated with respect to applicator 36. Drive unit and encoder 40 can control translation and rotation of work piece 42 through multi-axis stage 46. In particular, drive unit 40, under the control of computer 12, rotates work piece 32 in a direction shown by arrow 48 or a reverse direction. The work piece 42, supported on mounts 44, can be moved in a translational direction along the z-axis or in a vertical direction along the x-axis, through control of multi-axis stage 46 by computer 12. Work piece 42 can be gradually moved in the direction of the z-axis through the resin application process such that the resin is deposited on the work piece along a helical path. The velocity of the movement of work piece 42 in the direction of the z-axis is dependent upon a number of factors, such as the physical characteristics of the resin, the size and shape of applicator 36, the desired thickness of the resin coating and the distance between the applicator tip and the work piece. In one exemplary embodiment, work piece 42 may be translated at a rate of one-half of the needle diameter per revolution of work piece 42. In such an embodiment, a stream of resin can physically contact the previous stream of resin as it is being applied. Factors including flow rate of the resin and translational speed of the applicator relative to the work piece can impact the uniformity of the coating thickness.

Work piece 42 can be moved in the direction of the x-axis to adjust the position of the applicator along the curvature of the outer surface of the work piece 42. For example, when the applicator is intended to be horizontal and tangential to the outer surface of the work piece, it may be necessary to occasionally adjust the work piece along x-axis. Computer 12 can determine the necessity of adjustment along the x-axis based on feedback provided by sensor 38. Sensor 38 can be coupled to both the applicator 36 and the surface of work piece 42 to determine the relative positions and distance between applicator 36 and work piece 42. Sensor 38 can be, for example, a capacitance sensor. Capacitance sensors can be convenient because they can be non-contact and high resolution. Other sensors that can be used include non contact optical probes, and eddy current sensors or contact probes like an air bearing LVDT, sold by Colorado Precision Instruments, Inc., of Boulder, Colo.

Sensor 38 can provide input to computer 12 regarding the distance between work piece 42 and applicator 36. Computer 12 can then control the multi-axis stage 46 movement of work piece 42 until position and distance of the work piece 42 and applicator 36 are properly calibrated. Alternatively, work piece 42 can be held stationary, except for rotation of work piece 42 as illustrated by arrow 48, while the applicator 36 translates along the work piece. In one embodiment, the calibration can be completed prior to coating work piece 42. In another embodiment, calibration can occur during the coating process, but this requires sensor 38 to assess the relative positions of applicator 36 and work piece 42 through any coated material already applied to the work piece 42.

The position and movement of applicator 36 and work piece 42 relative to each other during the application process can contribute to the evenness of the surface of work piece 42 after resin is applied. This heightens the importance of controlling the distance between applicator tip and the surface of work piece 42 and the work piece's movement relative to the applicator tip.

Curing unit 34 can be used to actively cure resin applied to the work piece. Curing unit 34 can be mounted so that it is horizontal and tangential to an outer surface of the work piece 42 similar to the orientation of applicator 36. Alternatively, curing unit 34 could be oriented vertically with respect to the work piece or at any other location. Curing unit 34 can include a shield and a light or thermal source, for example, a UV LED. The specific components in curing 34 may depend upon the type of resin applied to work piece 42 and corresponding appropriate methods for curing that resin. In one embodiment, curing unit 34 can be mounted to the same base as applicator 36, but positioned any desired distance behind it. This allows curing unit 34 to actively cure resin already applied to work piece 42 while leaving a constant margin of resin already applied, but not yet cured between the applicator 36 and curing unit 34.

In an embodiment where a urethane acrylate is used as a coating resin, the resin can be cured using a UV LED, or, for example, a fluorescent lamp. A UV LED or other curing source can have uniform intensity or can have graduated intensity. For example, the curing source could contain multiple UV LEDs with graduated intensity such that LEDs located nearer the applicator 36 have lower intensity than LEDs located further from the applicator 36. In some embodiments, such an arrangement could decrease visual artifacts of the coating process.

Because the curing process could involve radical polymerization, which is inhibited by oxygen, curing unit can also flood the targeted resin-coated surface of work piece 42 with a gas substantially free of oxygen and water vapor such as nitrogen from gas source 28 to purge oxygen from the surface of the resin to aid in curing. The curing unit 34 shield can substantially contain the application of gas and UV to a resin-coated area of work piece 42 surrounded by the curing unit 34 shield. Computer 12 can control the rate of nitrogen supplied to curing unit 34 and applied to work piece 42 surface along with controlling the irradiance of the LED or temperature of a thermal source in curing unit 34. In an alternate embodiment, with resin such as a urethane or an epoxy thermosetting resin, a thermal source can be used to cure the resin or to accelerate the cure rate of the resin.

Figure 2:
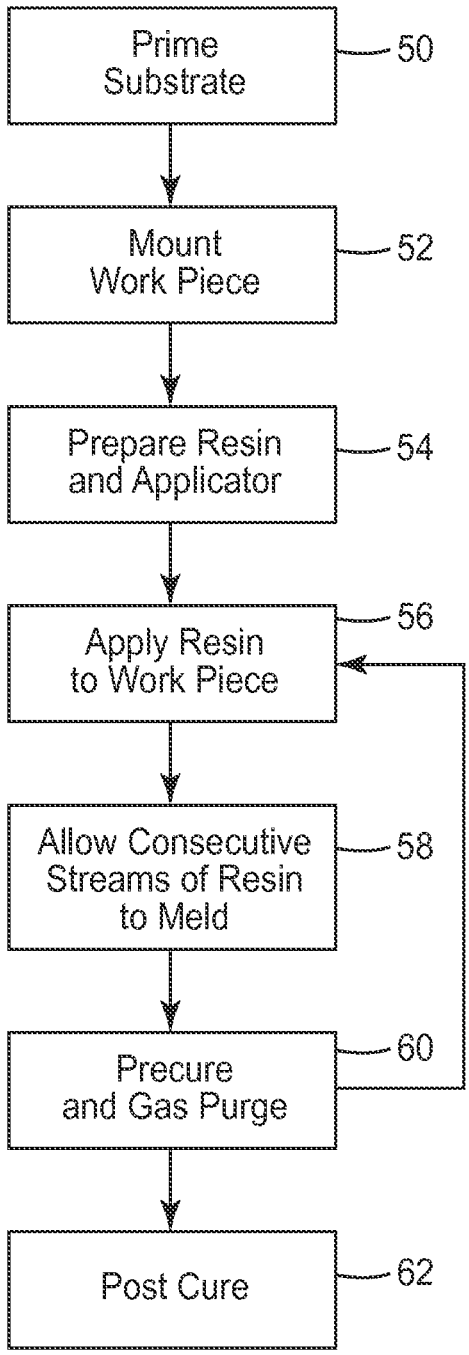
FIG. 2 is a flow chart of a method for coating a work piece with resin.

FIG. 2 shows a flow chart of a method for coating a work piece with resin. The method can begin with step 50, priming the substrate, or the uncoated work piece. The surface of the work piece 42 can be cleaned, for example, with a non-shedding wiper. Primer can be applied to the work piece to increase adhesion of the resin to the work piece 42. For example, primer sold under the trade name of ScotchPrime 389, sold by the 3M Company of Maplewood, Minn. could be used. After applying primer, appropriate finishing steps such as baking the work piece to promote adhesion of the primer to the work piece, or cleaning any excess primer off of the surface of work piece 42 can additionally be taken.

The details of step 52, mounting the work piece 42, will depend upon the actual work piece, mount, and multi-stage axis used. In one embodiment, work piece 42 may be a hollow cylinder with one closed and one open end, as described above. Such a work piece 42 can be mounted to a spindle adaptor connected to mount 44 using pins, bolts or any other appropriate fastening method.

Step 54, preparing the resin and applicator, can be completed in any order relative to steps 50 and 52. The resin can be a variety of polymeric materials as described above. Steps included in preparing the resin will depend on the specific types of resin used. Several common steps include mixing the resin, heating the resin, and allowing the resin to sit to allow air to escape the mixture. The resin can be loaded into a material source 30, such as described with respect to FIG. 1. The material source can then be heated such that the resin achieves a constant stable temperature. Typically, this temperature will be above the temperature of the work piece 42. This allows the work piece 42 to act as a heat sink when the resin is applied. In another embodiment, the temperature of the resin and the work piece 42 can be similar or approximately the same. The material source can be connected to the applicator using a feed hose with a valve or any other appropriate connection method. Prior to beginning application of the resin to the work piece, the resin can be purged by beginning resin flow. This eliminates air that may be present in the material source or applicator, and increases the temperature of the applicator or needle to operating temperature so that thermal expansion of the needle and resin viscosity can stabilize prior to initializing application to the work piece 42.

Applying resin to the work piece, step 56, involves ensuring that the applicator 36 is in a proper location relative to work piece. The gap between the two components can be set using a capacitance sensor or by any other method. The distance between the applicator and the work piece can be related to the desired coating thickness. For instance, the distance may be 10%, 50%, 100%, 500% or 1,000%, or any other desired relationship to the desired resin coating thickness.

Step 56 also includes setting the speeds of various system components. For example, the computer 12 may rotate the work piece, through control of the drive unit, at a speed of one rpm, two rpm, five rpm, or more or any speed in between. The translational speed of the work piece can be related to the needle diameter, for example, one-half needle diameter per revolution. Additionally, the speed with which the material source supplies resin to the applicator must also be set. This speed will also impact the thickness of the coating. For example, a material source such as a syringe pump may deliver material at a rate of about 10 cc/hour, 15 cc/hour, 20 cc/hour or any other appropriate rate. While the actual resulting resin thickness will depend on numerous factors, exemplary thicknesses can be about 5 μm, 50 μm, 100 μm, 150 μm, 500 μm or 1 mm, or any thickness in between.

Step 58 includes allowing resin applied to a work piece to meld, or self level. When consecutive streams or rings of resin are deposited such that they are adjacent to each other, when undisturbed, they will meld together to form a self-leveling surface. In some embodiments, it may take a single rotation of the work piece for rings of resin to meld together. In embodiments where the temperature of the resin is greater than the temperature of the work piece when the resin is applied to the work piece, the work piece can act as a heat sink. This can increase the viscosity of the resin to allow it to self-level, but not to flow to destroy the uniformity of the coating surface. For example, in some embodiments, the viscosity of the resin may be below about 2,000 centipoise (cP) when applied to a work piece, but above about 10,000 cP shortly after application.

Step 60 includes pre-curing the resin after consecutive streams of resin have been allowed to meld together. As discussed above, a curing unit can photolytically or thermally cure resin already applied to the work piece as the work piece is concurrently being coated. Pre-curing can be an active process. For example, a curing unit may expose leveled resin to a UV LED. The resin can also be purged with a substantially oxygen and water vapor free gas, such as nitrogen. In an alternate embodiment, pre-curing may be a passive process. In an embodiment where the resin is blended like an epoxy upon application, the resin may self-cure. The pre-cure step can cure the resin so that it will not deform with movement or light touches and is less likely to collect debris. As a result, some embodiments achieve higher levels of cleanliness for the resin and can be excimer ablated more accurately.

Applying 56, melding 58, and pre-curing 60 can happen simultaneously to different portions of a work piece. Additionally, a single work piece can be coated and cured multiple times to achieve a desired coating thickness. Once each of these steps has been performed on the coated surface of the work piece, the entire work piece can optionally be cured a second time if necessary or desired in the post cure step 62. Post cure 62 can harden the coating of the work piece so that the surface can be successfully ablated and can provide a more robust coating for handling. Post cure step 62 may include a second UV or thermal cure, or gas purge, with the same or different sources as the pre-cure, for example, a fusion lamp or baking in an oven. Step 62 can include any other appropriate method, such as air cure with a conventional fluorescent tube type lamp system. The resin coating may shrink during the curing processes so that the final thickness is slightly less than the thickness of the resin when first applied to the work piece.

Figure 3:
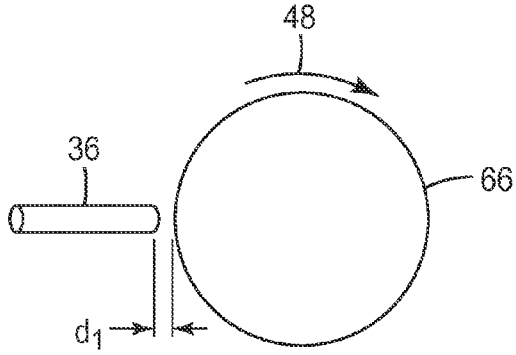
FIG. 3 shows an applicator for applying resin to a cylindrical work piece.

FIG. 3 shows an applicator 36 for applying resin to a work piece 66. As work piece 66 is rotated in the direction of arrow 48, or in an opposite direction, applicator 36 can apply resin to the surface of the work piece such that it is deposited along a helical path. The distance $d_1$ between the tip of applicator 36 and work piece 66 can be maintained substantially constant by use of a sensor and control of the movement of work piece 66 as discussed above. In one embodiment, $d_1$ may vary by as little as 2 μm or less during the coating process. The desired distance $d_1$ can be set in relation to the desired coating thickness. For example, the distance may be 10%, 50%, 100%, 500% or 1,000%, or any other desired relationship to the desired resin coating thickness.

Figure 4A:
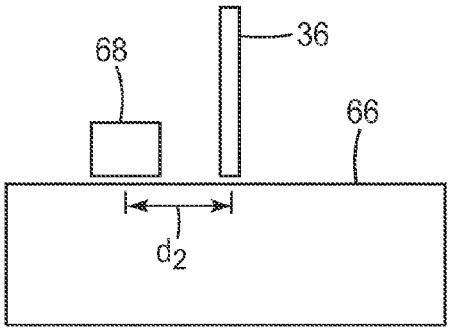
FIG. 4A is a top view of a curing element housing and applicator for a cylindrical work piece.
Figure 4B:
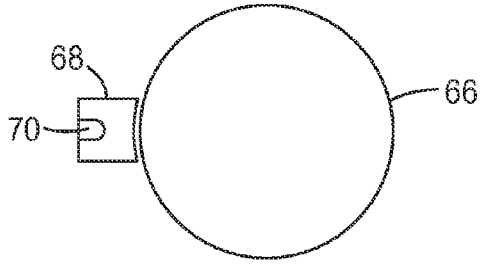
FIG. 4B is a side view of a curing element, curing element housing, and applicator for a cylindrical work piece.
Figure 4C:
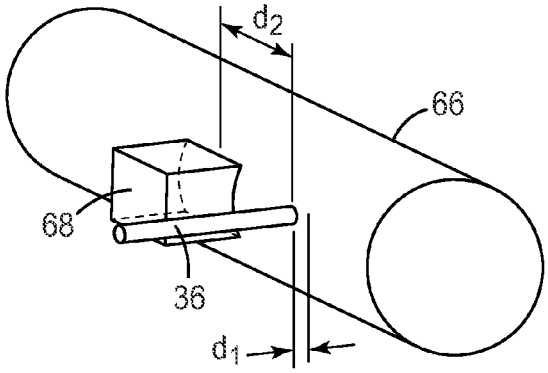
FIG. 4C is a perspective view of a curing element housing and applicator for a cylindrical work piece.

FIGS. 4A-4C are views of a curing element housing and applicator for a cylindrical work piece. FIG. 4A is a top view showing the relationships between the curing element housing 68, applicator 36 and work piece 66. The distance $d_2$ between the curing element housing 68 and applicator 36 can be sufficiently large to time for allow consecutive rings or streams of resin to self-level by melding together. In one embodiment, $d_2$ may be about 1, 2, 2.5 or 3 centimeters or any other desired distance.

FIG. 4B is a side view of a curing element 70, curing element housing 68, and applicator 36 for a cylindrical work piece 66. In one embodiment, the lower perimeter of the curing element housing 68 can conform to the surface of work piece 66 such that any gas contained by the curing element housing or shield that escapes negligibly impacts the curing of resin not surrounded by the curing element housing 68. Curing element 70 can be in one embodiment, a UV LED, or a thermal source. The distance $d_1$ between curing element 70 and the surface of work piece 66 can depend on the intensity of the UV or thermal source in curing element 70, desired level of curing, desired curing speed, type of resin applied to work piece 66 and along with other factors. FIG. 4C is a perspective view of curing element housing 68, applicator 36 and cylindrical work piece 66, further illustrating the relationship between these three components and distances $d_1$ and $d_2$.

Figure 5:
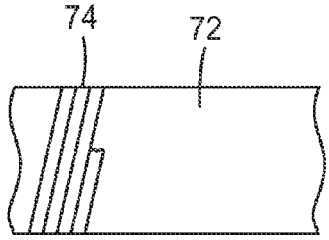
FIG. 5 is an exemplary application pattern for coating a cylindrical work piece with resin.

FIG. 5 is an exemplary application pattern for resin coating a cylindrical work piece. A portion of a work piece 72 is shown with consecutive streams or rings of resin 74 deposited on its surface. When work piece is rotated along a longitudinal axis and shifted laterally, a single continuous stream of resin deposited by an applicator can form a helical path.

Figure 6:
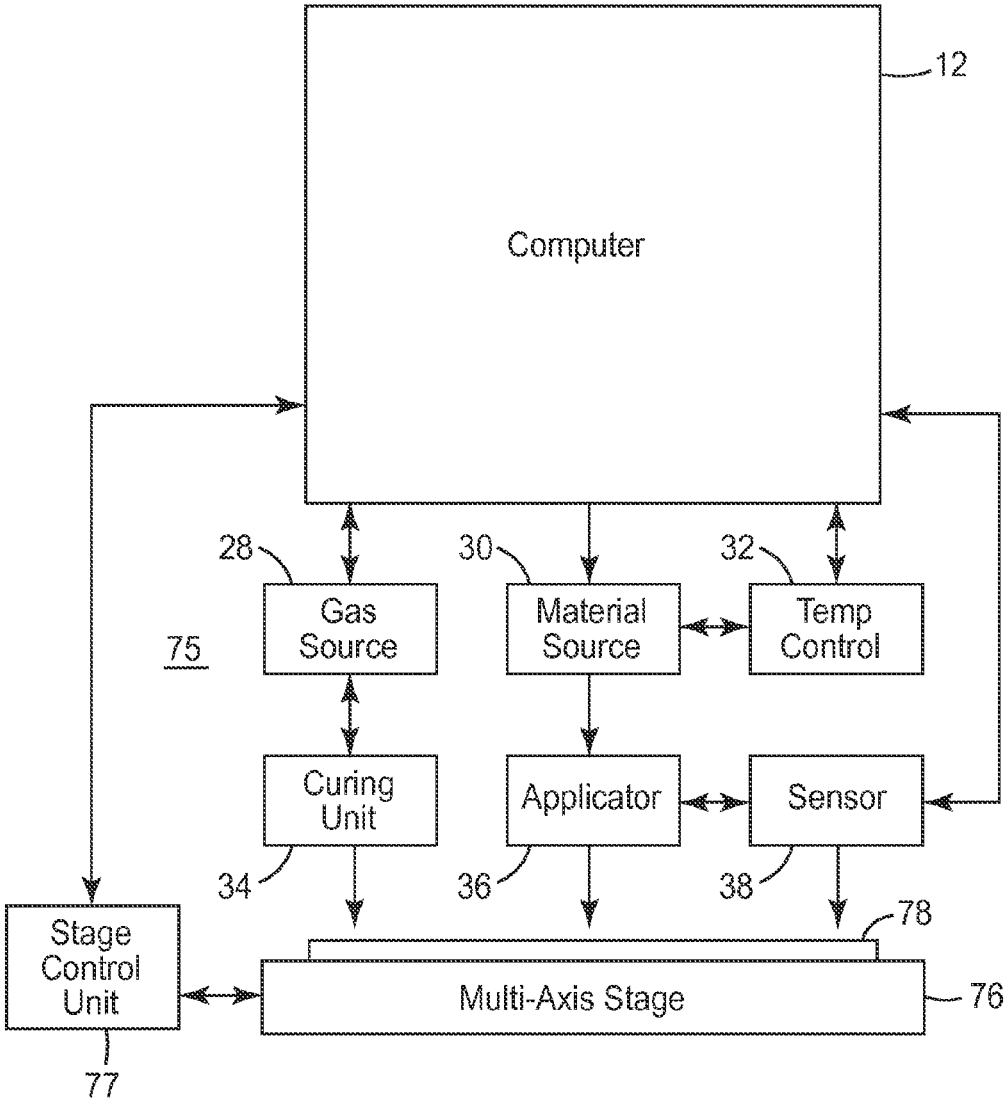
FIG. 6 is a block diagram of a system for coating a planar work piece with resin.

FIG. 6 is a block diagram of a system 75 for coating a planar work piece 78. A planar work piece 78 can be any desired shape such as a square, rectangle, circle, triangle or any irregular shape. A planar work piece 78 can be formed from any desired substrate, such as any substrate discussed above with respect to cylindrical work pieces.

System 75 is controlled by a computer 12. Gas source 28, curing unit 34, material source 30, applicator 36, temperature control 32, and sensor 38 can function in generally the same was as the same components shown in FIG. 1. In system 75, instead of being mounted horizontally, applicator 36 can be mounted vertically so as to deposit resin on a relatively horizontal surface of planar work piece 78.

Planar work piece 78 is mounted on multi-axis stage 76 and moved in relation to applicator 36. Stage control unit 77 is controlled by computer 12 and directs the movement of multi-axis stage 76. Any appropriate multi-axis stage 76 can be used in system 75. Multi-axis stages are known in the art and include any device having multiple axes for moving a work piece in multiple translational directions with respect to a tool, in multiple rotational directions with respect to the tool, or in both multiple translational directions and multiple rotational directions with respect to the tool. A six-axis stage is possible for providing movement of a work piece in three translational directions and three rotational directions with respect to a tool. Five-axis stages are more commonly used, and five-axis stages provide for movement of a work piece in three translational directions and two rotational directions with respect to a tool. Examples of multi-axis stages, including five-axis stages, are currently commercially available from the following companies: ONA America, Inc. (US); Agie Charmilles (UK); Sodie (FR); and Mitsubishi (JP). The process of depositing the resin can involve moving the work piece 78 via the stage 76, moving the applicator 36, or moving both.

Figure 7A:
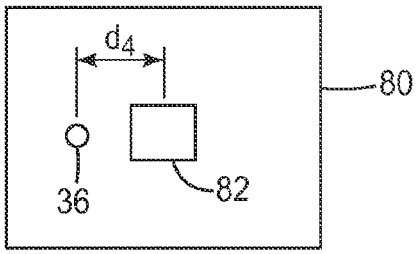
FIG. 7A is a top view of a curing element housing and applicator for a planar work piece.

FIG. 7A is a top view of a curing element housing 82 and applicator 36 for a planar work piece. While work piece 80 shown in FIG. 7A is rectangular, work piece 80 can be any appropriate or desired shape. Curing element housing 82 can be positioned above planar work piece 80 such that the perimeter of curing element housing 82 surrounds an area on the surface of planar work piece 80. In some embodiments, this area can be cured, as discussed above, through a UV or thermal cure and by flooding the surrounded area with gas such as nitrogen. Applicator 36 can be positioned a distance of $d_4$ from curing element housing 82 to allow for sufficient melding of consecutive streams of resin, as discussed above with respect to $d_2$.

Figure 7B:
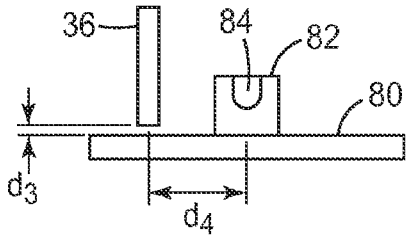
FIG. 7B is a side view of a curing element, curing element housing and applicator for a planar work piece.
Figure 7C:
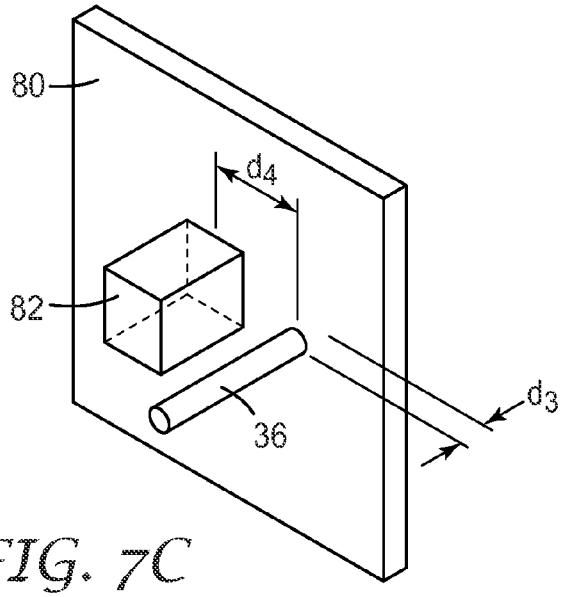
FIG. 7C is a perspective view of a curing element housing and applicator for a planar work piece.

FIG. 7B is a side view of a curing element housing 82, curing element 84 and applicator 36 for a planar work piece 80. The distance $d_3$ between the tip of applicator 36 and the surface of planar work piece 80 can be determined based on factors such as those discussed with respect to $d_1$ above. The shape of the lower perimeter of curing element housing 82 can be substantially planar to allow minimal distance between the lower perimeter of curing element housing 82 and the surface of planar work piece 80. This contains nitrogen gas or any other gas with which the curing element is flooded to the surrounded surface area. Curing element 84 can be any desired thermal or UV source, for example, a UV LED. FIG. 7C is a perspective view of a curing element housing 82, applicator 36 and planar work piece 80, showing an exemplary spatial relationship between each of the above three elements.

Figure 8A:
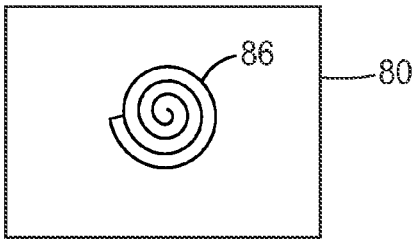
FIG. 8A is an exemplary application pattern for coating a planar work piece with resin.
Figure 8B:
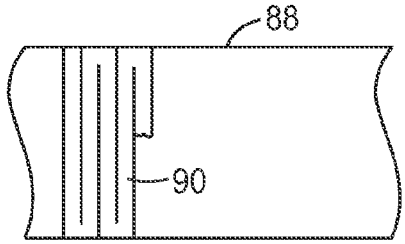
FIG. 8B is an exemplary application pattern for coating a planar work piece with resin.

FIGS. 8A and 8B are exemplary application patterns for coating a planar work piece with resin. In the embodiment illustrated in FIG. 8A, resin 86 is deposited on work piece 80 in a spiral pattern. Such a pattern can be achieved by movement of the work piece 80, movement of an applicator or both. FIG. 8B shows a back-and-forth pattern for coating a planar work piece 88 with resin 90. In this embodiment, as in the configuration shown in FIG. 8A, or in any other desired configuration, the resin coating pattern can be created by moving the work piece 88, an applicator, or both. While only two patterns for coating a work piece are shown here, any desired pattern can be achieved.

While the present invention has been described in connection with several exemplary embodiments, it will be understood that many modifications will be readily apparent to those skilled in the art, and this application is intended to cover any adaptations or variations thereof. For example, various types of materials can be used for the work piece or for the resin, and various configurations of the illustrated systems may be used without departing from the scope of the invention. This invention should be limited only by the claims and equivalents thereof.

What is claimed is:

1. A method for coating a work piece with resin, the method comprising:

providing a generally cylindrically shaped work piece;

rotating the work piece about a longitudinal axis;

providing an applicator;

applying a controlled volume of liquid resin to the work piece with the applicator as a lateral location of the applicator along the surface of the work piece is shifted such that the resin is deposited on the work piece along a helical path;

wherein consecutive rings of resin are allowed to meld together to form a self-leveling surface;

providing a curing unit capable of curing the resin applied to the work piece and capable of lateral movement along the surface of the work piece;

actively curing at least a portion of the resin during the applying step, comprising moving the curing unit laterally along the surface of the work piece in order to cure the resin applied to the work piece by the applicator while leaving a margin of the resin already applied to the work piece but not yet cured between the applicator and the curing unit; and wherein the applicator and curing unit are substantially normal to a shared plane parallel to the longitudinal axis and wherein the applicator and curing unit are positioned on the same side of the work piece.

2. The method of claim 1, wherein the temperature of the resin is greater than the temperature of the work piece.

3. The method of claim 2, wherein the resin is heated prior to the applying step.

4. The method of claim 1, wherein the curing step comprises applying a UV source or a thermal source to a portion of the resin already applied to the work piece.

5. The method of claim 4, wherein an intensity of the UV source or the thermal source is graduated.

6. The method of claim 4, wherein the UV source or thermal source is surrounded by a housing.

7. The method of claim 6, wherein a gas substantially free of oxygen and water vapor is applied to the area of the resin surrounded by the housing.

8. The method of claim 1, wherein a ring of resin being applied to the work piece physically contacts a previous ring of resin already applied to the work piece.

9. The method of claim 1, where in the applicator is a flat-tipped needle.

10. The method of claim 1, wherein the applicator is a needle with a rectangular, square, or round perimeter.

11. The method of claim 1, wherein the work piece includes at least one of: aluminum, nickel, brass, glass, copper, steel, chrome and a ceramic.

12. The method of claim 1, further comprising, prior to the rotating step, priming the work piece.

13. The method of claim 1, wherein the resin includes at least one of: urethane acrylate, a two-part urethane and an epoxy.

14. The method of claim 1, wherein the thickness of the cured resin is within the range of 5 μm to 1 mm.

15. The method of claim 1, wherein the distance between the needle applicator and the surface of the work piece is within the range of 10% to 1000% of a desired coating thickness.

16. The method of claim 1, wherein the needle moves laterally with respect to the work piece.

17. The method of claim 1, wherein the work piece moves laterally with respect to the needle.

18. The method of claim 1, wherein the work piece and the needle move laterally with respect to each other.

19. The method of claim 1, further comprising a second curing step after the applying step is complete.

20. The method of claim 1, wherein the margin of the resin already applied to the work piece but not yet cured remains constant during at least a portion of the curing step.

* * * * *